United States Patent [19]

Hartmann et al.

[11] 4,414,262

[45] Nov. 8, 1983

[54] SHAPED BODY OF A SETTABLE MINERAL MATERIAL WITH REINFORCEMENT FIBERS EMBEDDED THEREIN

[75] Inventors: Ludwig Hartmann, Kaiserslautern; Otto Ambros, Mannheim, both of Fed. Rep. of Germany

[73] Assignee: Firma Carl Freudenberg, Weinheim, Fed. Rep. of Germany

[21] Appl. No.: 398,311

[22] Filed: Jul. 15, 1982

[30] Foreign Application Priority Data

Oct. 27, 1981 [DE] Fed. Rep. of Germany ..... 3142598

[51] Int. Cl.[3] ..... D03D 13/00

[52] U.S. Cl. ..... 428/222; 264/136; 264/257; 264/258; 264/333; 264/518; 428/288; 428/289; 428/373; 428/703; 428/294

[58] Field of Search ..... 264/136, 137, 257, 258, 264/333, 518; 428/703, 421, 422, 294, 295, 373, 374, 288, 222

[56] References Cited

U.S. PATENT DOCUMENTS

| | | | |
|---|---|---|---|
| 3,637,457 | 1/1972 | Gothard et al. | 428/703 |
| 4,031,285 | 6/1977 | Miller et al. | 428/294 |
| 4,265,981 | 5/1981 | Campbell | 428/373 |
| 4,275,117 | 6/1981 | Crandall | 428/373 |

*Primary Examiner*—James J. Bell

*Attorney, Agent, or Firm*—Kenyon & Kenyon

[57] ABSTRACT

The present invention provides for a shaped body comprising a settable mineral material such as cement or gypsum with reinforcement fibers embedded therein. The reinforcement fibers, which are endless and consist of an organic polymer material, are processed as a non-woven fabric characterized by a parallelized scatter texture.

10 Claims, 1 Drawing Figure

SHAPED BODY OF A SETTABLE MINERAL MATERIAL WITH REINFORCEMENT FIBERS EMBEDDED THEREIN

FIELD OF THE INVENTION

The present invention relates to a shaped body of a settable mineral material such as cement or gypsum, with reinforcement fibers embedded therein. More specifically, the reinforcement fibers are endless fibers consisting of an organic polymer material, which is processed as a nonwoven fabric characterized by a parallelized scatter texture.

BACKGROUND OF THE INVENTION

It is known that the mechanical properties of cement are improved by incorporating asbestos fibers therein. Asbestos offers great advantages in such applications, due to its fiber structure and its resistance to the alkalinity of cement. The pertinent relationships between asbestos and various settable mineral materials have been known for some time. Such relationships have long been considered and explored as they relate to the fabrication of asbestos fiberboard. Despite the advantages of asbestos, there are health hazards associated both with the production and also the processing of asbestos fibers. Fine asbestos fibers, when inhaled, trigger a carcinogenic effect in the body's pulmonary system. This situation forced industry to find a substitute for the asbestos fiber skeleton traditionally used to improve the mechanical properties of settable mineral materials.

Many suggestions have been made for manufacturing sheet materials comparable to those made with asbestos. For example, fibers with a cellulose and synthetic polymer base were suggested. However, such fibers are characterized by insufficient chemical durability. Furthermore, the mechanical properties are unsatisfactory in that the rheological changes in the structure of the hydrated cement deviate too much from those of the fiber material. Also, considerable difficulties arise in obtaining a uniform distribution of the reinforcement fibers in the mineral material. These difficulties, as they relate to, e.g., incorporation of the fibers into a cement mixture, are associated particularly with the specific properties of the available polymer materials, whose properties differ substantially from those of natural asbestos fibers.

It is an object of the present invention to provide a shaped body of a polymer material embedded in a mineral material, which can be manufactured without the above-mentioned difficulties, and which also exhibits qualities that are mechanically as well as chemically comparable to those exhibited by the above-mentioned asbestos/cement fiber sheets.

SUMMARY OF THE INVENTION

The present invention provides for a shaped body comprising a settable mineral material such as cement or gypsum with reinforcement fibers embedded therein. The reinforcement fibers, which are endless and consist of an organic polymer material, are processed as a nonwoven fabric characterized by a parallelized scatter texture.

DETAILED DESCRIPTION OF THE INVENTION

Figure 1:
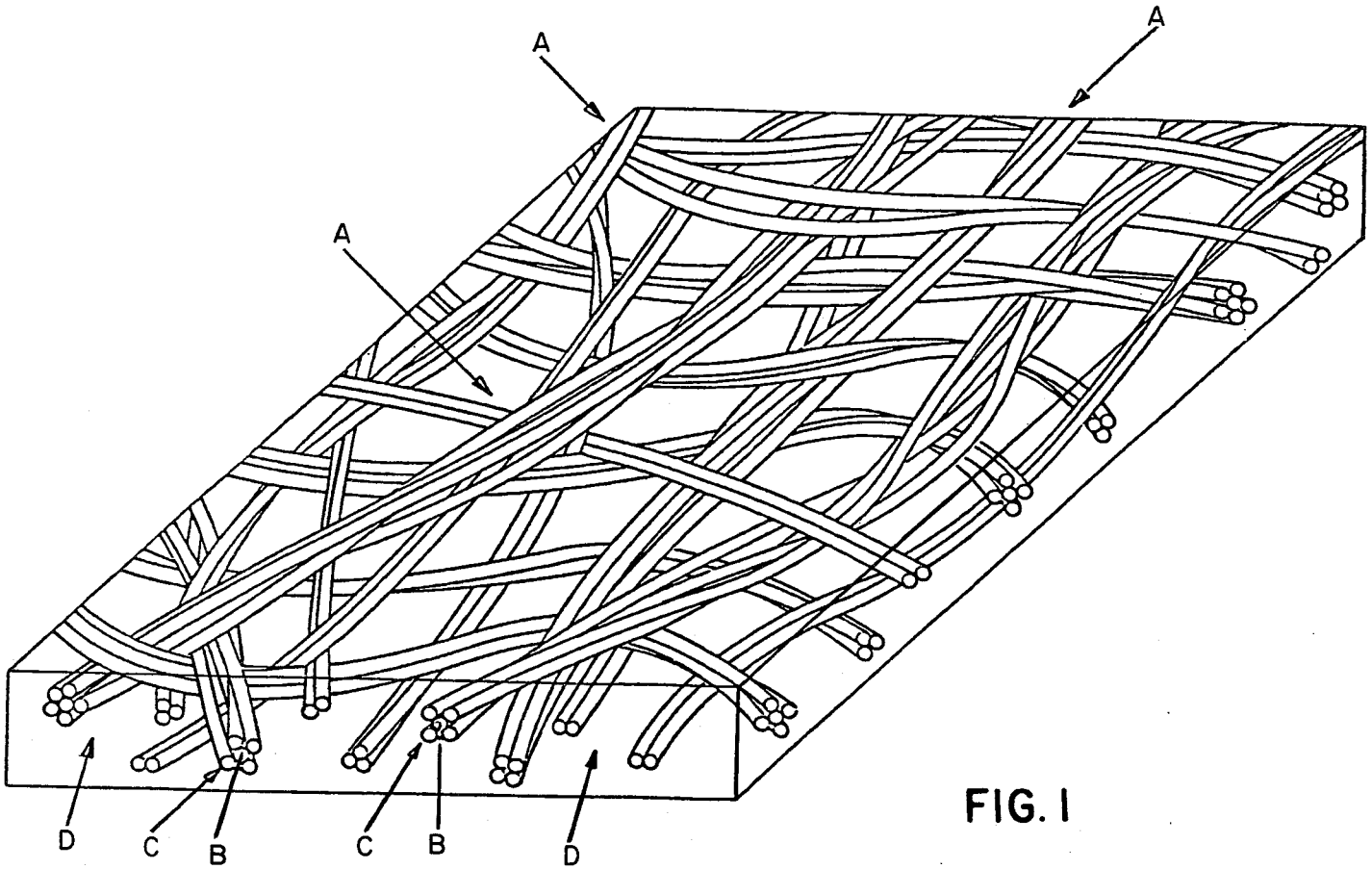
FIG. 1 is a schematic representation of a perspective section of a shaped body according to the present invention, in sheet form.

Contrary to the conventional technique in the art of incorporating short reinforcement fibers into a settable mixture, e.g., a cement mixture, it was found that it is advantageous to utilize a fiber assembly of a given structure so that the mineralized components of the invention can be incorporated without adverse effect on the fiber orientation. The strength of a shaped body so obtained can be set with regard to predetermined values, both lengthwise and crosswise. Also, the use of endless fibers obviates any health hazard that may arise from fiber dust.

Surprisingly, it was found that the strength properties of the endless reinforcement fibers are very advantageously utilized if they are processed to form a nonwoven fabric characterized by a parallelized scatter texture. The fibers of such a nonwoven fabric are processed further so that they are put together predominantly in bundles of continuously varying shape. The resulting loose and dense areas alternate over the entire fabric and have an irregular texture characterized by partially changing internal directional twists, i.e., both clockwise and counterclockwise twists. The not-yet-set mineral material, when introduced, can thereby penetrate, at certain spacings, the interior of each bundle's fiber structure where it forms a firm skeleton structure when set, and thereby prevents later relative shifting of the fiber bundle. As a result, the strength properties of the reinforcement fibers, and of the set mineral material, optimally supplement each other. A shaped body of the design thus described makes it not only possible to manufacture relatively simple, very strong parts, but also to manufacture shaped bodies with a complicated shape, such as of pipes and other thin-walled hollow bodies.

In one preferred embodiment, the fibers themselves, which have been processed to form a nonwoven fabric characterized by a parallelized scatter texture, form bundles which are densified at least at definite intervals. Densification, as used in the present disclosure, is understood to mean a degree of densification which largely prevents penetration of the mineral material mixture into the spaces between the fibers. This degree of densification results in the fibers being more geometrically fixed or localized even when external forces are applied.

It may be that some of the fibers utilized are susceptible to partial or complete chemical attack by the mineral material used. As a consequence, the bundles of fibers may contain protective fibers or parts of fibers that cover and protect those fibers susceptible to partial or complete chemical degradation. Particularly preferred is the use of bicomponent fibers which are characterized by a fiber core of high-strength polymer material, entirely covered by a protective jacket of a polymer material which is not susceptible to attack by the chemicals present in any given embodiment of the invention. The two components may alternatively be arranged so that the protective material is not entirely covering the high-strength core but rather is one or more fibers arranged parallel to the core fiber. As a consequence, the high-strength, supporting polymer is at least partially protected from chemical attack. Both bicomponent arrangements may be utilized together in a single embodiment. Also, it is possible to combine yarn strands in a scatter textured nonwoven fabric so that the fibers on the outside of the fabric are chemically protective fibers, while the inside fibers exhibit high-strength, supportive characteristics.

As mentioned earlier, it was previously customary in the art to embed short reinforcement fibers in the reaction mixture of the mineral material, then shape the mixture and let it set. However, depending on the type of fiber used and its shape, considerable difficulties could arise with respect to obtaining a uniform distribution of the fibers throughout the mineral material. This, in turn, would lead to defective final products.

The present invention also provides a method for manufacturing shaped bodies, which ensures uniform and targeted embedment of the reinforcement fibers into the settable mineral material.

Such uniformity is ensured by utilizing a nonwoven fabric of endless fibers, characterized by a parallelized scatter texture. The fabric is saturated with the mineral material reaction mixture. After shaping the saturated fabric as desired, the mineral material reaction mixture is set.

Such a method is not only useful for manufacturing small, complicatedly shaped bodies. Rather, it may also be utilized, e.g., for the reinforcement of cement or concrete slabs used in road construction. In such an application, the prefabricated reinforcement fabric would be taken to the construction site and embedded in situ into the layer of fresh cement or concrete by unrolling the fabric and impregnating it with the cement or concrete mixture by using mechanically operated vibrators.

FIG. 1 provides a schematic representation of a perspective section of a shaped body of the present invention, in sheet form. The top view shows the arrangement of the parallelized endless fiber strands (A) which have been deposited without any preferred direction, or orientation, thus forming a scatter texture. The side views show the bundle-like arrangement of endless fibers. The inner fibers (B) of such bundles are protected by the outer fibers (C) against the chemical effects of the, e.g., alkaline cement material filling (D). As discussed earlier, another embodiment of the invention envisions the use of bicomponent fibers characterized by a high-strength core with a chemically protective inert jacket of a polymer material.

The fiber structure, viz. the nonwoven fabric, may be made, e.g., by means of a device as is described in German Patent 15 60 801, herein incorporated by reference. The device therein merely provides one way to form a nonwoven fabric of endless fibers. Any suitable device or method, as will be apparent to those skilled in the art, may be used to prepare such a nonwoven fabric characterized by a parallelized scatter texture.

After the nonwoven fabric has been formed, it is then impregnated with, e.g., an aqueous cement mixture. It has been found to be advantageous to add to the cement mixture a dispersion of an inorganic polymer material such as an acrylic-acid ester polymerisate or copolymerisate. This improves the bond between the cement mixture and the fiber skeleton. Optimum results are obtained by admixing 5 to 20% of a commercially available acrylate dispersion.

The invention may be understood further by the following example. Unless otherwise indicated, all ratios and percentages are weight-based.

EXAMPLES

A spinning device as is described in German Patent 15 60 801 is used. This particular device utilizes a spinning extruder having a worm diameter of 45 mm. The polymer melt emerging from the spinning extruder is fed by means of spinning pumps to spinning nozzles with 130 holes each, arranged in rows of three. The holes of the spinning nozzles have a capillary diameter of 0.3 mm and a capillary length of 0.75 mm. There is a water-cooled fall shaft 2 m long under the spinning nozzles so that the formed filaments or fibers can be cooled down. An injector operated by compressed air is used for spin-drawing the pre-tensioned filaments. The spinning temperature is 285° C.

Such a spinning device is utilized to spin polyethylene terephthalate (PET) fibers with a relative visosity of 1.385 at 30° C. The viscosity is determined in a 0.5% solution of a mixture of phenol/o-dichlorobenzene (3:2).

Utilizing air, the freshly spun groups of PET threads are pulled off and stretched with a velocity of 6000 m/min. They are subsequently fed to a conveyor belt and are collected thereon until an area weight of 2000 g/m$^2$ is reached. Furthermore, the fibers are laid down on the conveyor belt without a preferred orientation so that the resulting fabric is characterized by a parallelized scatter texture. The threads have a breaking strength of 3.4 N/dtex, a tear elongation of 83% and a boiling shrinkage of less than 1%. The bulk density of the threads is 1.361 kg/m$^3$ and the individual filament titer is 5.9 dtex. The randon-fabric arrangement of the fibers is characterized by grouping of two, three and four fibers with some single fibers.

The planar structure obtained by the process described above is subsequently saturated and finished with a 50% cement mixture, to which 10% of an acrylate dispersion has been admixed. The fabric, now saturated with cement, is shaped into a sheet and allowed to set. The weight ratio of fabric to cement mixture is 200 g to 300 g. The sheet so obtained has high strength and notch impact tenacity. The fibers of the fabric are embedded in the cement structure as a matrix, and the hydrating particles are distributed and embedded substantially within the interfiber voids.

The invention has been described in terms of specific embodiments set forth in detail, but it should be understood that these are by way of illustration only, and that the invention is not necessarily limited thereto. Modifications and variations will be apparent from this disclosure and may be resorted to without departing from the spirit of this invention, as those skilled in the art will readily understand. Accordingly, such variations and modifications of the disclosed products or processes are considered to be within the purview and scope of this invention and the following claims.

What is claimed is:

1. A shaped body comprising a nonwoven fabric of endless reinforcement fibers embedded in an alkaline settable mineral material the endless fibers having no preferred direction or orientation, and said fibers being comprised of a bundle of individual parallel fiber strands, wherein at least one fiber strand at the core of the bundle is protected against chemical interaction with said alkaline settable material by the outermost fiber strands of said bundle which are comprised of a polymeric material which is inert to the alkaline settable material.

2. A shaped body according to claim 1 wherein the mineral material is selected from the group consisting of cement and gypsum.

3. The shaped body according to claim 1 wherein at least one of the fiber strands is comprised of polyethylene terphthalate.

4. The shaped body according to claim 1 wherein said settable mineral material further comprises about 5% to about 20% of an organic polymer material.

5. The shaped body according to claim 4 wherein said polymer material is selected from the group consisting of an acrylic acid polymerisate or copolymerisate.

6. A method for the manufacture of a shaped body comprising:

a. embedding a nonwoven fabric of endless reinforcement fibers in an alkaline settable mineral material, the endless fibers having no preferred direction or orientation, and said fibers being comprised of a bundle of individual parallel fiber strands, wherein at least one fiber strand at the core of the bundle is protected against chemical interaction with said alkaline settable material by the outermost fiber strands of said bundle which are comprised of a polymeric material which is inert to the alkaline settable material;

b. shaping the product of step (a) into a desired form; and c. causing the settable mineral material to set.

7. The method according to claim 6 wherein the settable material is gypsum or cement.

8. The method according to claim 6 wherein the settable material further comprises about 5% to about 20% of an inorganic polymer material.

9. The method according to claim 6 wherein the settable mineral material further comprises an acrylic acid ester polymerisate or copolymerisate.

10. The method according to claim 6 wherein at least one of the fiber strands is comprised of polyethylene terphthalate.

* * * * *

UNITED STATES PATENT AND TRADEMARK OFFICE

CERTIFICATE OF CORRECTION

PATENT NO. : 4 414 262

DATED : November 8, 1983

INVENTOR(S) : Ludwig Hartmann et al

It is certified that error appears in the above-identified patent and that said Letters Patent are hereby corrected as shown below:

In Column 4, line 5, change "EXAMPLES" to --EXAMPLE--

Column 4, line 27, change "2000" to --200--

Signed and Sealed this

Tenth Day of January 1984

[SEAL]

*Attest:*

GERALD J. MOSSINGHOFF

*Attesting Officer*

*Commissioner of Patents and Trademarks*